US006367256B1

(12) United States Patent
McKee

(10) Patent No.: US 6,367,256 B1
(45) Date of Patent: Apr. 9, 2002

(54) EXHAUST GAS RECIRCULATION WITH CONDENSATION CONTROL

(75) Inventor: Heather McKee, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/817,623

(22) Filed: Mar. 26, 2001

(51) Int. Cl.[7] ..... F02B 33/44
(52) U.S. Cl. ..... 60/605.2; 123/568.12
(58) Field of Search ..... 60/605.2, 602; 123/568.12, 568.18, 569; 165/164

(56) References Cited

U.S. PATENT DOCUMENTS

| | | | | | |
|---|---|---|---|---|---|
| 4,075,994 | A | * | 2/1978 | Mayer et al. | 123/568.12 |
| 4,426,848 | A | * | 1/1984 | Stachowicz | 60/605.2 |
| 4,835,963 | A | * | 6/1989 | Hardy | 60/602 |
| 5,425,239 | A | * | 6/1995 | Gobert | 60/605.2 |
| 5,517,976 | A | * | 5/1996 | Bachle et al. | 123/569 |
| 5,806,308 | A | * | 9/1998 | Khair et al. | 60/605.2 |
| 5,927,075 | A | * | 7/1999 | Khair | 60/605.2 |
| 5,974,802 | A | * | 11/1999 | Blake | 60/605.2 |
| 6,244,256 | B1 | * | 6/2001 | Wall et al. | 123/568.12 |
| 6,301,887 | B1 | * | 10/2001 | Gorel et al. | 60/605.2 |

FOREIGN PATENT DOCUMENTS

| | | | | |
|---|---|---|---|---|
| JP | 405071428 | A | * | 9/1991 ..... 60/605.2 |
| JP | 2000038962 | A | * | 7/1998 |
| JP | 11013550 | A | * | 1/1999 |
| JP | 11166453 | A | * | 6/1999 |
| JP | 11287588 | A | * | 10/1999 |

* cited by examiner

*Primary Examiner*—Thomas Denion
*Assistant Examiner*—Thai-Ba Trieu
(74) *Attorney, Agent, or Firm*—Brooks & Kushman P.C.

(57) ABSTRACT

A system for providing exhaust gas recirculation in a multi-cylinder compression ignition internal combustion engine include an EGR valve in communication with an exhaust side of the engine to selectively divert a portion of the exhaust through an EGR circuit to an intake side of the engine and a two-pass, full flow EGR cooler disposed within the EGR circuit having a cross-sectional area sized to increase EGR flow rates and reduce fouling. In one embodiment, a bypass valve is positioned downstream of the EGR valve and upstream of the EGR cooler to selectively divert at least a portion of recirculated exhaust gas around the EGR cooler based on engine operating conditions to reduce or eliminate condensation of the recirculated exhaust gas. A condensation trap may be positioned downstream of the EGR cooler to collect any EGR condensate which is subsequently vaporized using an associated electric heater having appropriate piping to bypass the turbocharger and deliver the gaseous mixture to the tailpipe. The EGR cooler bypass may be used alone or in combination with the condensation trap depending upon the particular application. A charge air cooler bypass valve may also be provided alone or in combination with the EGR cooler bypass and/or condensation trap(s).

22 Claims, 2 Drawing Sheets

EXHAUST GAS RECIRCULATION WITH CONDENSATION CONTROL

BACKGROUND OF THE INVENTION

1. Field of the Invention

The present invention relates to a system for providing exhaust gas recirculation (EGR) for a compression-ignition internal combustion engine which reduces or controls formation of EGR condensate.

2. Background Art

A number of strategies have been developed for alternative charge air handling and turbocharging to drive and control exhaust gas recirculation (EGR) to reduce emissions for truck, automotive, and stationary engines used in power plants. One approach uses a single state variable geometry turbocharger (VGT), in combination with an EGR circuit to achieve the desired ratio of EGR rate and air/fuel ratio under transient and steady-state operation. In this arrangement, the EGR circuit generally includes a modulating (proportional) or on/off EGR valve, an EGR cooler, and an EGR rate measuring device with appropriate tubing or integral passages to direct exhaust gas to the engine intake under appropriate operating conditions. The management of EGR flow is performed by an electronic control unit (ECU). The ECU may use closed loop control of the EGR flow which is dependent on EGR rate measurement. The ECU may also control the VGT and/or EGR valve based on input from the rate measurement device to regulate EGR flow.

The EGR cooler plays an important role in overall emissions control. Recirculated exhaust gas acts as a dilutant to the charge air which also lowers the volumetric efficiency of the engine. This leads to a lower (richer) air/fuel ratio in comparison to a non-EGR engine because the recirculated exhaust gas has less oxygen content than the charge air due to the oxygen being consumed during the previous combustion process. For an EGR engine to maintain the same air/fuel ratio as a non-EGR engine under the same operating conditions generally requires an increased turbo boost which may in turn require an increase in back pressure to drive the recirculated exhaust gas.

The EGR cooler provides a restriction in the EGR circuit which creates a pressure drop that the turbocharger must overcome by generating more boost pressure to create back pressure to drive the EGR flow. Generating this additional boost compared to a non-EGR engine under the same operating conditions puts added demands on the turbocharger. For example, the turbocharger must withstand higher pressure ratios, higher rotational velocities, higher temperatures, and may experience an increased probability of high cycle fatigue. The EGR cooler can also lower the recirculated exhaust gas to such a temperature that results in condensation which is acidic in nature and may lead to premature degradation of various components including the intake manifold and cylinder liner and kits. Fouling or soot accumulation in the EGR cooler can lead to a progressive performance degradation of the cooler by increasing the pressure drop and resulting in a higher air side outlet temperature which may affect engine performance and fuel economy.

SUMMARY OF THE INVENTION

An object of the present invention is to provide a system for utilizing EGR in a multi-cylinder compression ignition internal combustion engine.

Another object of the present invention is to provide an EGR system with selective EGR cooler bypass to reduce or eliminate condensation.

A further object of the present invention is to provide an EGR system with a condensation trap to reduce or eliminate component wear due to EGR condensate.

Yet another object of the present invention is to provide an EGR system having a full flow, two-pass EGR cooler.

Another object of the present invention is to reduce EGR component fouling by maintaining a high EGR mass flow velocity.

A further object of the present invention is to avoid localized boiling within the EGR cooler under conditions providing low coolant flow and high EGR flow.

In carrying out the above objects and other objects, features, and advantages of the present invention, a system for providing exhaust gas recirculation in a multi-cylinder compression ignition internal combustion engine includes an EGR valve in communication with an exhaust side of the engine to selectively divert a portion of the exhaust through an EGR circuit to an intake side of the engine and a two-pass, full flow EGR cooler disposed within the EGR circuit having a cross-sectional area sized to increase EGR flow rates and reduce fouling. In one embodiment, a bypass valve is positioned downstream of the EGR valve and upstream of the EGR cooler to selectively divert at least a portion of recirculated exhaust gas around the EGR cooler based on engine operating conditions to reduce or eliminate condensation of the recirculated exhaust gas. A condensation trap may be positioned downstream of the EGR cooler to collect any EGR condensate which is subsequently vaporized using an associated electric heater having appropriate piping to bypass the turbocharger and deliver the gaseous mixture to the tailpipe. The EGR cooler bypass may be used alone or in combination with the condensation trap depending upon the particular application. A charge air cooler bypass may also be provided for selectively bypassing the charge air cooler for a portion or all of the charge air from the turbocharger before being mixed with the EGR flow to reduce or eliminate condensation in the intake manifold. The charge air cooler bypass may be used alone or in combination with the EGR cooler bypass and/or one or more condensation traps and associated heater.

The present invention provides a number of advantages relative to the prior art. For example, the present invention provides an EGR strategy which utilizes increased EGR mass flow to reduce fouling of EGR components. The use of a full flow EGR cooler which receives full coolant flow from the engine water pump increases the cooling capacity and reduces the potential for localized boiling. An EGR cooler bypass used alone or in combination with a condensation trap may be used to reduce or eliminate the effects of EGR condensate.

The above advantages, and other advantages, objects, and features of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
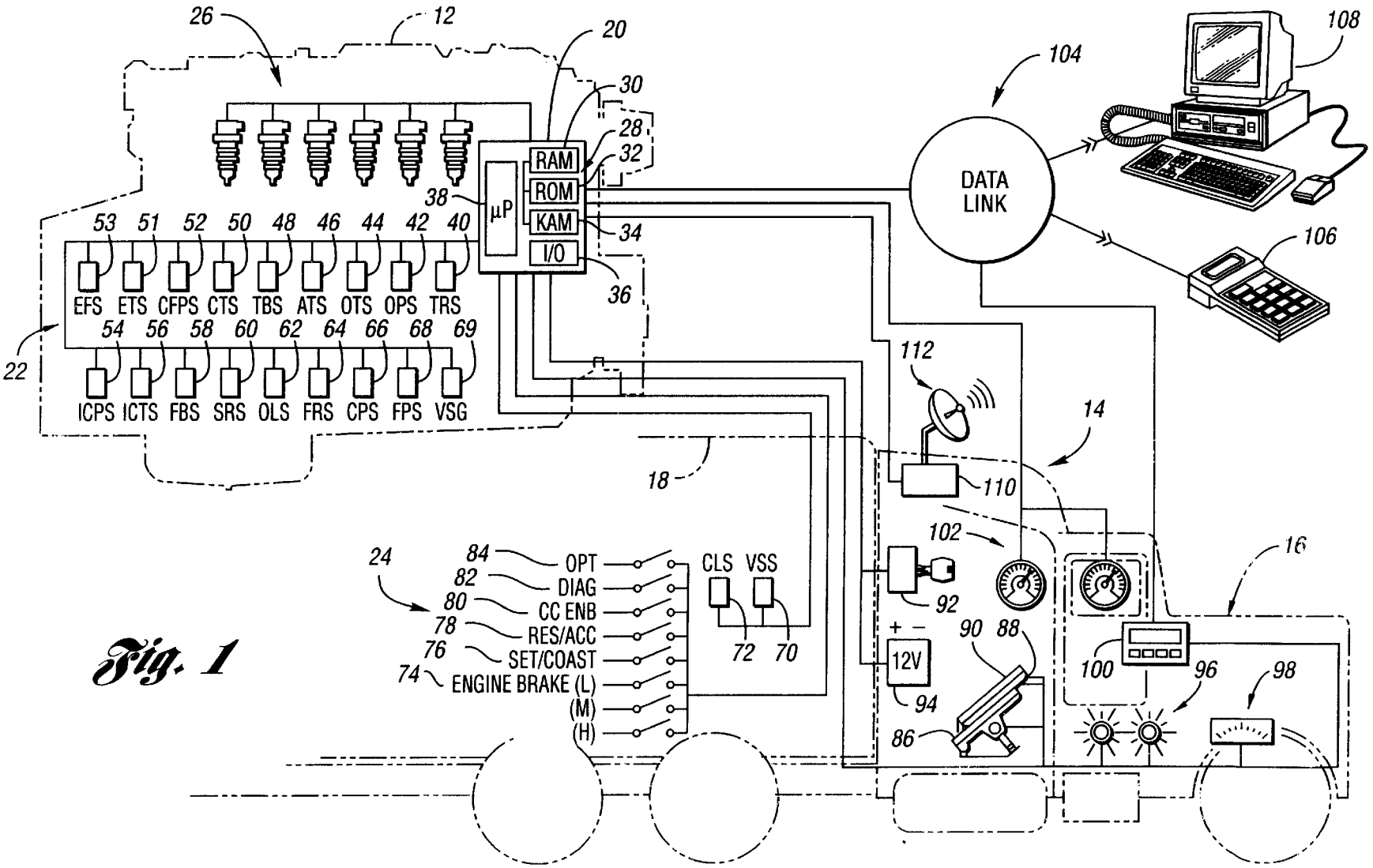
FIG. 1 is a block diagram illustrating one application of a system or method for providing EGR in a multi-cylinder compression ignition engine according to one embodiment of the present invention.

FIG. 1 provides a schematic/block diagram illustrating operation of a system or method for providing EGR in a representative application according to one embodiment of the present invention. System 10 includes a multi-cylinder compression ignition internal combustion engine, such as a diesel engine 12, which may be installed in a vehicle 14 depending upon the particular application. In one embodiment, vehicle 14 includes a tractor 16 and semi-trailer 18. Diesel engine 12 is installed in tractor 16 and interfaces with various sensors and actuators located on engine 12, tractor 16, and semi-trailer 18 via engine and vehicle wiring harnesses as described in further detail below. In other applications, engine 12 may be used to operate industrial and construction equipment, or in stationary applications for driving generators, compressors, and/or pumps and the like.

An electronic engine control module (ECM) 20 receives signals generated by engine sensors 22 and vehicle sensors 24 and processes the signals to control engine and/or vehicle actuators such as fuel injectors 26. ECM 20 preferably includes computer-readable storage media, indicated generally by reference numeral 28 for storing data representing instructions executable by a computer to control engine 12. Computer-readable storage media 28 may also include calibration information in addition to working variables, parameters, and the like. In one embodiment, computer-readable storage media 28 include a random access memory (RAM) 30 in addition to various non-volatile memory such as read-only memory (ROM) 32, and keep-alive or non-volatile memory (KAM) 34. Computer-readable storage media 28 communicate with a microprocessor 38 and input/output (I/O) circuitry 36 via a standard control/address bus. As will be appreciated by one of ordinary skill in the art, computer-readable storage media 28 may include various types of physical devices for temporary and/or persistent storage of data which includes solid state, magnetic, optical, and combination devices. For example, computer readable storage media 28 may be implemented using one or more physical devices such as DRAM, PROMS, EPROMS, EEPROMS, flash memory, and the like. Depending upon the particular application, computer-readable storage media 28 may also include floppy disks, CD ROM, and the like.

In a typical application, ECM 20 processes inputs from engine sensors 22, and vehicle sensors/switches 24 by executing instructions stored in computer-readable storage media 28 to generate appropriate output signals for control of engine 12. In one embodiment of the present invention, engine sensors 22 include a timing reference sensor (TRS) 40 which provides an indication of the crankshaft position and may be used to determine engine speed. An oil pressure sensor (OPS) 42 and oil temperature sensor (OTS) 44 are used to monitor the pressure and temperature of the engine oil, respectively.

An air temperature sensor (ATS) 46 is used to provide an indication of the current intake air temperature. A turbo boost sensor (TBS) 48 is used to provide an indication of the boost pressure of a turbocharger which is preferably a variable geometry or variable nozzle turbocharger as described in greater detail below. Coolant temperature sensor (CTS) 50 is used to provide an indication of the coolant temperature. Depending upon the particular engine configuration and application, various additional sensors may be included. For example, engines which utilize exhaust gas recirculation (EGR) according to the present invention preferably include an EGR temperature sensor (ETS) 51 and an EGR flow sensor (EFS) 53. EFS 53 is preferably a hot wire anemometer type sensor which detects a differential temperature of two heated elements to determine the mass flow rate of EGR through the EGR circuit. The heated elements preferably provide pyrolitic cleaning by being heated to a temperature to reduce or prevent soot accumulation. Alternatively, a $\Delta P$ sensor may be used to determine the EGR flow rate as described in U.S. Application Ser. No. 09/641,256 filed Aug. 16, 2000 and assigned to the assignee of the present invention, the disclosure of which is hereby incorporated by reference in its entirety.

Applications utilizing a common rail fuel system may include a corresponding fuel pressure sensor (CFPS) 52. Similarly, an intercooler coolant pressure sensor (ICPS) 54 and temperature sensor (ICTS) 56 may be provided to sense the pressure and temperature of the intercooler coolant. Engine 12 also preferably includes a fuel temperature sensor (FTS) 58 and a synchronous reference sensor (FRS) 60. SRS 60 provides an indication of a specific cylinder in the firing order for engine 12. This sensor may be used to coordinate or synchronize control of a multiple-engine configuration such as used in some stationary generator applications. An EGR cooler (FIG. 2) and corresponding temperature sensor may also be provided to cool recirculated exhaust gas prior to introduction to the engine intake.

Engine 12 may also include an oil level sensor (OLS) 62 to provide various engine protection features related to a low oil level. A fuel restriction sensor (FRS) 64 may be used to monitor a fuel filter and provide a warning for preventative maintenance purposes. A fuel pressure sensor (FPS) 68 provides an indication of fuel pressure to warn of impending power loss and engine fueling. Similarly, a crankcase pressure sensor (CPS) 66 provides an indication of crankcase pressure which may be used for various engine protection features by detecting a sudden increase in crankcase pressure indicative of an engine malfunction.

System 10 preferably includes various vehicle sensors/switches 24 to monitor vehicle operating parameters and driver input used in controlling vehicle 14 and engine 12. For example, vehicle sensors/switches 24 may include a vehicle speed sensor (VSS) which provides an indication of the current vehicle speed. A coolant level sensor (CLS) 72 monitors the level of engine coolant in a vehicle radiator. Switches used to select an engine operating mode or otherwise control operation of engine 12 or vehicle 14 may include an engine braking selection switch 74 which preferably provides for low, medium, high, and off selections, cruise control switches 76, 78, and 80, a diagnostic switch 82, and various optional, digital, and/or analog switches 84. ECM 20 also receives signals associated with an accelerator or foot pedal 86, a clutch 88, and a brake 90. ECM 20 may also monitor position of a key switch 92 and a system voltage provided by a vehicle battery 94.

ECM 20 may communicate with various vehicle output devices such as status indicators/lights 96, analog displays 98, digital displays 100, and various analog/digital gauges 102. In one embodiment of the present invention, ECM 20 utilizes an industry standard data link 104 to broadcast various status and/or control messages which may include engine speed, accelerator pedal position, vehicle speed, and the like. Preferably, data link 104 conforms to SAE J1939 and SAE J1587 to provide various service, diagnostic, and control information to other engine systems, subsystems, and connected devices such as display 100. Preferably, ECM 20 includes control logic to determine EGR flow and temperature and to selectively divert at least a portion of the EGR flow around the EGR cooler to reduce or eliminate condensation of the recirculated exhaust gas.

A service tool 106 may be periodically connected via data link 104 to program selected parameters stored in ECM 20 and/or receive diagnostic information from ECM 20. Likewise, a computer 108 may be connected with the appropriate software and hardware via data link 104 to transfer information to ECM 20 and receive various information relative to operation of engine 12, and/or vehicle 14.

Figure 2:
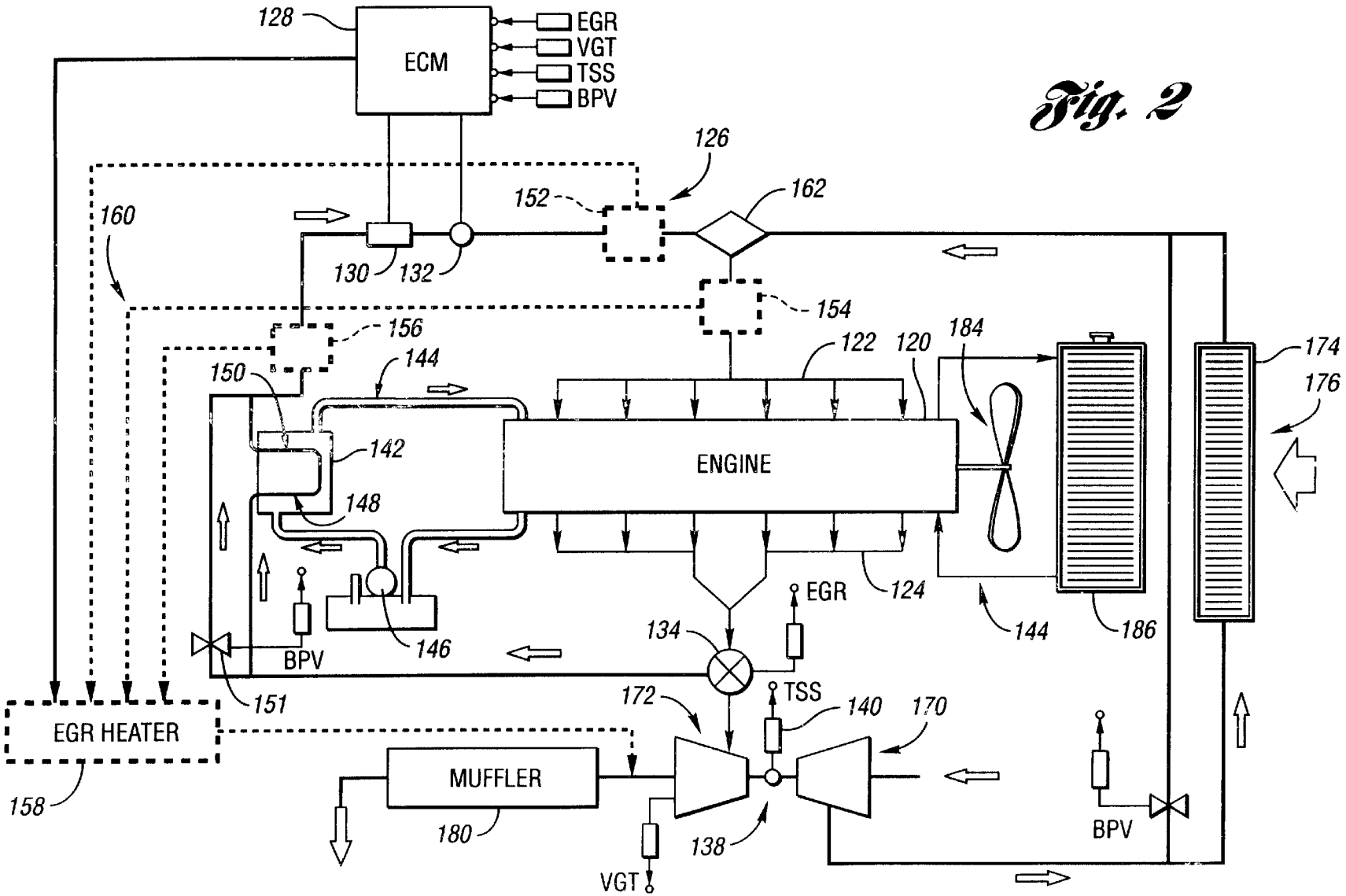
FIG. 2 is a block diagram illustrating a representative EGR circuit for a compression ignition engine according to one embodiment of the present invention.

FIG. 2 is a block diagram illustrating a representative EGR system with associated EGR temperature sensor and flow sensor in communication with an ECM having control logic to control operation of the EGR circuit. Engine 120 includes an intake manifold 122, an exhaust manifold 124, and an exhaust gas recirculation (EGR) system indicated generally by reference numeral 126. An engine control module (ECM) 128 includes stored data representing instructions and calibration information for controlling engine 120. ECM 128 communicates with various sensors and actuators including EGR sensors such as EGR flow sensor 130 and EGR temperature sensor 132. As described above, EGR flow sensor 130 is preferably an anemometer-type sensor which generates a signal based on convective cooling of a heated wire by the EGR flow. ECM 128 controls EGR system 126 via actuators such as an EGR valve 134. In addition, ECM 128 preferably controls a variable nozzle or variable geometry turbocharger (VGT) 138 and monitors an associated turbo speed sensor 140 and turbo boost sensor as described with reference to FIG. 1.

EGR system 126 preferably includes an EGR cooler 142 which is connected to the engine coolant circuit indicated generally by reference numeral 144. EGR cooler 142 is preferably a full-flow cooler connected in-line with the engine coolant system, i.e. EGR cooler 142 receives the entire coolant flow for engine 122. As such, EGR cooler 142 may be directly coupled to a corresponding water or coolant pump 146, or may be placed at a different location in the engine cooling circuit depending upon the particular application. In addition, EGR cooler 142 is preferably a two-pass cooler having a first pass 148 and second pass 150 for the recirculated exhaust gas passing through the core.

Embodiments of the present invention preferably utilize an EGR cooler with full coolant flow as described above because a partial coolant flow cooler may result in localized boiling when the engine is in a condition of low coolant flow and high EGR flow. This boiling could increase the temperature of the EGR cooler core to a point which would degrade cooler life and/or result in a failure of the cooler brazing material. According to the present invention, a two-pass EGR cooler is preferable over a single-pass design. Although a two-pass cooler generally has a larger pressure drop than a single pass design, the two-pass cooler has a similar pressure drop as a single pass cooler when associated piping is considered and has better cooling performance. The two-pass cooler also maintains a higher EGR mass flow velocity resulting from a smaller cross-sectional area so that EGR flows more easily and fouling is reduced. Fouling is a function of the following parameters according to:

$$1.094 * D * V^{-1.14}((T_G - T_S)/T_S))^{0.7}$$

where D represents particle density in g/m$^3$, V represents velocity in m/s, $T_G$ represents gas stream temperature, and $T_S$ represents the surface temperature. As the above equation illustrates, the parameter that most influences fouling is the velocity of the airstream. As such, the present invention uses a two-pass cooler with cross-sectional area sized to reduce fouling by increasing velocity of the EGR flow.

An EGR cooler bypass valve (BPV) 151 may be selectively operated by ECM 128 to control temperature of the EGR flow by diverting none, some, or all of the flow around EGR cooler 142. Valve 151 may be a solenoid operated on/off valve so that some or all of the EGR flow will bypass EGR cooler 142 under operating and ambient conditions that promote condensation. Although a modulating bypass valve may be useful for some applications, it is not required because modulation of EGR valve 134 may be used to control the overall EGR flow. Preferably, ECM 128 operates valve 151 to control the EGR temperature based on current ambient and operating conditions to reduce or eliminate condensation of the recirculated exhaust gas. The control strategy may use ambient temperature, relative humidity, intake manifold temperature and pressure, air/fuel ratio, and %EGR, for example, to determine when to control EGR valve 134 and bypass valve 151 to reduce or eliminate condensation. Alternatively, or in combination, EGR system 126 may include one or more condensation traps 152, 154, 156 to collect condensate and deliver it to a corresponding electric heater 158 via appropriate plumbing 160. EGR heater 158 is preferably controlled by ECM 128 to periodically vaporize condensate which is then exhausted downstream of VGT 138. The condensation trap(s) used alone or in combination with the EGR bypass valve and/or modulation of the EGR valve operate as means for reducing or controlling condensation.

In operation, ECM 128 controls EGR system 126 and VGT 138 based on current operating conditions and calibration information to mix recirculated exhaust gas with charge air via mixer 162 which is preferably a pipe union. The combined charge air and recirculated exhaust gas is then provided to engine 120 through intake manifold 122. In one preferred embodiment, engine 120 is a 6-cylinder compression-ignition internal combustion engine. ECM 128 includes control logic to monitor current engine control parameters and operating conditions to control EGR system 126. During operation of engine 120, intake air passes through compressor portion 170 of VGT 138 which is powered by turbine portion 172 via hot exhaust gasses. Compressed air travels through charge air cooler 174 which is preferably an air-to-air cooler cooled by ram air 176. Charge air passes through cooler 174 to mixer 162 which is preferably a pipe union where it is combined with recirculated exhaust gas based on current engine operating conditions. Exhaust gas exiting engine 120 through exhaust manifold 124 passes through EGR valve 134 where a portion of the exhaust gas may be selectively diverted through EGR cooler 142. Valve 151 is selectively operated to divert a portion (none, some, or all) of the diverted exhaust gas around cooler 142 to adjust the temperature of the recirculated exhaust gas. The EGR flow passes through one or more optional condensation traps 152, 154, and/or 156 positioned as illustrated, past EGR flow sensor 130 and temperature sensor 132 to mixing valve 162 where it is combined with compressed charge air. The remaining exhaust gasses not diverted by EGR valve 134 pass through turbine portion 172 of VGT 138 and muffler 180 before being exhausted to atmosphere. EGR cooler 142 cools the heated exhaust gas using engine coolant circuit 144. Engine coolant is in turn cooled via a cooling fan 184 and radiator 186.

In an alternative embodiment, a bypass valve may be added to the intake side of engine 120 upstream of charge air cooler (CAC) 174 to selectively divert some, all, or none of the charge air from compressor portion 170 of VGT 138 around CAC 174. A charge air cooler (CAC) bypass valve would be selectively operated similar to bypass valve 151 under conditions which may promote condensation within the intake manifold based on current engine operating and ambient conditions. For example, a CAC bypass valve control strategy may consider ambient temperature, relative humidity, intake manifold temperature and pressure, air/fuel ratio, and %EGR, for example, to determine how much of the charge air (if any) to divert around CAC 174. This strategy may be based on a measured, estimated, or predicted temperature for the charge air or the combined charge after mixing with EGR flow at mixer 162. Depending upon the particular application, the CAC bypass valve may be used alone or in combination with the EGR cooler bypass and/or condensation trap(s) and heater described above.

As such, the present invention provides an EGR strategy which utilizes increased EGR mass flow to reduce fouling of EGR components. The use of a full flow EGR cooler which receives full coolant flow from the engine water pump increases the cooling capacity and reduces the potential for localized boiling. An EGR cooler bypass used alone or in combination with a condensation trap and associated heater may be used to reduce or eliminate the effects of EGR condensate on various engine components.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for providing exhaust gas recirculation in a multi-cylinder compression ignition internal combustion engine having an intake side and an exhaust side, the system comprising:

an EGR valve in communication with the exhaust side of the engine to selectively divert a portion of exhaust from the internal combustion engine through an EGR circuit to an intake side of the engine;

a turbocharger having a turbine in fluid communication with the exhaust side of the engine and the EGR circuit and a compressor in fluid communication with the intake side of the engine;

a full flow cooler disposed within the EGR circuit for selectively cooling recirculated exhaust gas passing therethrough, wherein substantially all engine coolant passes through the full flow cooler;

a control module in communication with the EGR valve and the turbocharger for controlling flow of exhaust gas through the EGR circuit; and means for reducing formation of condensation within at least one of the intake side and exhaust side of the engine.

2. The system of claim 1 wherein the full flow cooler is directly coupled to an engine water pump that circulates substantially all of the engine coolant through the full flow cooler and the engine.

3. The system of claim 1 wherein the full flow cooler comprises a core having a cross-sectional area sized to increase EGR flow rate and reduce fouling.

4. The system of claim 1 wherein the full flow cooler comprises a multiple pass cooler having recirculated exhaust gas passing through a flow of engine coolant at least twice between an EGR ingress and an EGR egress of the full flow cooler.

5. The system of claim 1 wherein the means for reducing formation of condensation comprises:

a bypass valve disposed within the EGR circuit and in electrical communication with the control module, the bypass valve being selectively controlled to divert at least a portion of recirculated exhaust gas around the full flow cooler.

6. The system of claim 1 wherein the means for reducing formation of condensation within the EGR circuit comprises:

at least one condensation trap disposed within the EGR circuit.

7. The system of claim 6 wherein at least one condensation trap is positioned upstream relative to an EGR flow sensor.

8. The system of claim 6 wherein at least one condensation trap is positioned downstream of an EGR mixing valve which delivers recirculated exhaust gas to the intake side of the engine.

9. The system of claim 6 further comprising:

an electrical heater selectably controllable by the control module and in fluid communication with the at least one condensation trap and the exhaust side of the engine, the electrical heater being operated to vaporize condensate collected by the at least one condensation trap and deliver vaporized condensate to the exhaust side of the engine downstream of the turbocharger.

10. The system of claim 6 wherein at least one condensation trap is positioned downstream of an EGR flow measuring device and upstream of an EGR mixer which delivers recirculated exhaust gas to the intake side of the engine.

11. The system of claim 1 wherein the means for reducing condensation within the EGR circuit comprises:

a bypass valve disposed within the EGR circuit and in electrical communication with the control module, the bypass valve being selectively controlled to divert at least a portion of recirculated exhaust gas around the cooler; and at least one condensation trap disposed within the EGR circuit.

12. The system of claim 1 wherein the means for reducing formation of condensation comprises:

a bypass valve in electrical communication with the control module, the bypass valve being selectively controlled to divert at least a portion of charge air around a charge air cooler.

13. A system for providing exhaust gas recirculation in a multi-cylinder compression ignition internal combustion engine having an intake side and an exhaust side, the system comprising:

an EGR valve in communication with the exhaust side of the engine to selectively divert a portion of exhaust from the internal combustion engine through an EGR circuit to an intake side of the engine;

a turbocharger having a turbine in fluid communication with the exhaust side of the engine and the EGR circuit and a compressor in fluid communication with the intake side of the engine;

a full flow cooler disposed within the EGR circuit for selectively cooling recirculated exhaust gas passing therethrough, wherein substantially all engine coolant passes through the full flow cooler;

a condensation trap positioned in the EGR circuit to collect condensate formed by cooled recirculated exhaust gas;

a heater in communication with the condensation trap and the exhaust side of the engine downstream of the turbocharger, the heater being selectively operated to vaporize collected condensate; and a control module in communication with the EGR valve, the turbocharger, and the heater for controlling flow of exhaust gas through the EGR circuit and reducing EGR condensate reaching the turbocharger.

14. The system of claim 13 wherein the condensation trap is positioned downstream of the full flow cooler.

15. The system of claim 14 further comprising:

an EGR flow rate measuring device positioned in the EGR circuit, wherein the condensation trap is positioned downstream of the EGR flow rate measuring device.

16. The system of claim 13 wherein the full flow cooler comprises a multiple pass cooler having recirculated exhaust gas passing through a flow of engine coolant at least twice between an EGR ingress and an EGR egress of the full flow cooler.

17. A system for providing exhaust gas recirculation in a multi-cylinder compression ignition internal combustion engine having an intake side and an exhaust side, the system comprising:

an EGR valve in communication with the exhaust side of the engine to selectively divert a portion of exhaust from the internal combustion engine through an EGR circuit to an intake side of the engine;

a turbocharger having a turbine in fluid communication with the exhaust side of the engine and the EGR circuit and a compressor in fluid communication with the intake side of the engine;

a full flow cooler disposed within the EGR circuit for selectively cooling recirculated exhaust gas passing therethrough, wherein substantially all engine coolant passes through the full flow cooler;

a bypass valve disposed within the EGR circuit and selectively controlled to divert at least a portion of recirculated exhaust gas around the full flow cooler under ambient or operating conditions which may result in formation of EGR condensate; and a control module in communication with the EGR valve and the turbocharger for controlling flow of exhaust gas through the EGR circuit and reducing EGR condensate reaching the turbocharger.

18. The system of claim 17 wherein the full flow cooler comprises a multiple pass cooler having recirculated exhaust gas passing through a flow of engine coolant at least twice between an EGR ingress and an EGR egress of the full flow cooler.

19. The system of claim 17 further comprising:

a charge air cooler in communication with the compressor of the turbocharger; and a charge air cooler bypass valve interposed the charge air cooler and the compressor, the charge air cooler bypass valve being selectively controlled to divert at least a portion of charge air around the charge air cooler under ambient or operating conditions which may result in formation of condensation.

20. A system for providing exhaust gas recirculation in a multi-cylinder compression ignition internal combustion engine having an intake side and an exhaust side, the system comprising:

an EGR valve in communication with the exhaust side of the engine to selectively divert a portion of exhaust from the internal combustion engine through an EGR circuit to an intake side of the engine;

a turbocharger having a turbine in fluid communication with the exhaust side of the engine and the EGR circuit and a compressor in fluid communication with the intake side of the engine;

a charge air cooler in selective fluid communication with the compressor of the turbocharger;

a charge air cooler bypass valve interposed the compressor of the turbocharger and the charge air cooler, the charge air cooler bypass valve being selectively controlled to divert at least a portion of charge air around the charge air cooler under ambient or operating conditions which may result in formation of condensation; and a control module in communication with the EGR valve, the turbocharger, and the bypass valve for controlling flow of exhaust gas through the EGR circuit and reducing formation of condensation.

21. The system of claim 20 further comprising:

a full flow cooler disposed within the EGR circuit for selectively cooling recirculated exhaust gas passing therethrough, wherein substantially all engine coolant passes through the full flow cooler; and a bypass valve disposed within the EGR circuit and selectively controlled to divert at least a portion of recirculated exhaust gas around the full flow cooler under ambient or operating conditions which may result in formation of EGR condensate.

22. The system of claim 21 further comprising:

a condensation trap positioned in the EGR circuit to collect condensate formed by cooled recirculated exhaust gas; and a heater in communication with the condensation trap and the exhaust side of the engine downstream of the turbocharger, the heater being selectively operated to vaporize collected condensate.

* * * * *